US005715979A

United States Patent [19]

Crandall

[11] Patent Number: 5,715,979

[45] Date of Patent: Feb. 10, 1998

[54] NO-PULSE RIFLE SLING

[76] Inventor: David L. Crandall, 11040 N. River Rd., Idaho Falls, Id. 83402

[21] Appl. No.: 824,209

[22] Filed: Mar. 25, 1997

[51] Int. Cl.[6] ..... F41C 23/02; F41C 33/00

[52] U.S. Cl. ..... 224/150; 224/913

[58] Field of Search ..... 224/149, 150, 224/220, 913

[56] References Cited

U.S. PATENT DOCUMENTS

| | | | |
|---|---|---|---|
| 4,542,840 | 9/1985 | Pepper, Sr. et al. | 224/150 |
| 5,082,155 | 1/1992 | Salvador | 224/159 |

FOREIGN PATENT DOCUMENTS

| | | | |
|---|---|---|---|
| 102681 | 9/1941 | Sweden | 224/913 |

OTHER PUBLICATIONS

Rocketto, Hap. "Slings a Necessary Aid" Shooting Sports USA, pp. 1, 10 and 11, vol. 10—No. 1, Jan. 1997.

*Primary Examiner*—Renee S. Luebke
*Assistant Examiner*—Timothy L. Maust

[57] ABSTRACT

Prior art slings used to support rifles during aiming and firing respond to the blood pressure pulse in the shooter's upper am resulting in rhythmic stress in the straps which extend to connect with the rifle. This is caused by the position and singular nature of the prior an attachment between that portion of the sling surrounding the shooter's upper arm and that portion of the sling which extends to the rifle. This interaction between the prior an slings and the shooter's pulse results in movement of the rifle and a reduction in practical accuracy. Slings of the present invention incorporate two attachments to that portion of the sling system which surrounds the shooter's arm and two non parallel straps extending to the rifle. By virtue of the location of these two attachments, the shooter's pulse can no longer create rhythmic stress in the straps extending to the rifle. Motion of the rifle during aiming and firing is reduced and practical accuracy is increased.

5 Claims, 9 Drawing Sheets

NO-PULSE RIFLE SLING

BACKGROUND OF THE INVENTION

1. Field

This invention relates to rifles and particularly to slings used to improve the practical accuracy of rifles. It is particularly directed to sling features which attach to the upper arm of the shooter and support the rifle to achieve minimum movement for maximum accuracy during firing.

2. History and Uses of Rifle Slings

The earliest sling was most likely nothing more than a simple carrying strap tied to the firearm, which allowed the musketeer or rifleman to hang the weapon over his shoulder or across his body so as to free his hands and ease the burden of transporting the firearm. As military powers began to expand in terms of the number of soldiers carrying firearms in the late 18th and early 19th centuries, enhanced features began to appear to include sling swivels to allow better attachment of slings to firearms and features to allow adjustment in the length of the sling. These adjustment features made it possible to better accommodate different body sizes and attire of soldiers.

Slings designed to additionally support the rifle during firing appeared in the first decade of the 20th century. A common example which came into use at about this time, is the U.S. Military M1907 sling. It is made primarily of leather and consists of four separable parts including two straps. Each strap is an inch and a quarter wide and about 3/16 inch thick. Until about 1938, the metal parts of the M1907 sling were made of blackened brass. Brass was replaced by Parkerized steel in later versions. The short strap is about two feet long and includes a metal double claw hook at one end fastened with metal rivets, and a metal rectangular ring connected at the other end in a loop of the leather created by sewn stitches. The short strap also includes multiple pairs of punched holes. The long strap is about 46 inches in length with another double claw hook attached at one end. The opposite end of the long strap is rounded off and includes multiple pairs of double holes. The claw hook of the short strap can be used in cooperation with the holes of the long strap or the short strap to attach the sling to the rifle lower or buttstock sling swivel. The claw hook of the long strap is used in cooperation with the holes of the long strap to attach the sling to the upper or forestock sling swivel. The long strap passes through the rectangular ring of the short strap to join these two major parts of the sling. The third and fourth separable parts of the M1907 sling consist of two sling keepers made of leather strips formed into loops with stitches. These sling keepers are normally located at the upper and lower loops of the long strap and serve to keep the sling laying flat against itself. The M1907 sling is shown in FIG. 1. The M1907 sling may be used as an effective means to carry the rifle in the configuration shown in FIG. 1, with the hook positions adjusted in the holes and the straps otherwise repositioned to allow the slack necessary to hang the rifle over the shoulder or across the body of the rifleman.

The prior art typically configures the M1907 sling as shown in FIG. 2 in preparation for use in support of the rifle during firing, and shown in FIG. 3 attached to the upper arm of the rifleman in position for firing. Some slight variations in this configuration are also used, however, in all cases where the sling is attached to the shooter's upper arm, the prior art draws the loop formed in the long strap together so that the inner and outer strap legs follow a parallel path between the shooter's upper arm and the sling swivel connected to the rifle. In the prior art typically represented by the configuration shown in FIG. 3, the sling forms one side of a support triangle completed by the forearm and upper arm of the rifleman. The sling and the bones of the rifleman's arm provided the support, thus minimizing the use of muscle to steady the rifle. The double hook of the long strap can be placed in different sets of holes to adjust the length of that portion of the sling between the shooter's arm and the rifle forestock sling swivel.

State of the Art in Competition Rifle Slings

The M1907 sling and other military type slings are used in some forms of rifle competition, primarily those restricted to the use of military rifles. The prior art also includes dedicated competition slings, not normally intended to serve the additional function as a carrier for the weapon. These slings are used when the competition is not restricted to military rifles. There are many variations of these competition rifle slings, however, they fall generally into two types. A first type uses a single strap to surround the arm and form the connection to the rifle. This first type of sling is used in the same way as the long strap of the M1907 sling to connect the rifle to the upper arm of the shooter. Buckles and holes or clamps are sometimes used in place of hooks, holes, and keepers to tighten the sling around the shooter's arm and to adjust the length of that portion of the sling between the shooter's arm and the rifle.

A second type of competition sling uses a separate component called a cuff to surround the shooter's arm. The cuff is connected to a strap which then joins the cuff to the rifle. In some cases this strap is detachably connected to the cuff, and in other cases it is not. The cuff will incorporate some means to allow adjustment to closely fit the shooter's upper arm. Often this means to allow adjustment consists of a buckle. The second type sling will also incorporate some means to accommodate adjustment in the length of the strap between the cuff and the rifle.

Most competition slings are made primarily of leather and often include gripping materials on the inner surface of the cuff or sling in the area of contact with the shooter's upper arm. This gripping material, typically consisting of a textured rubber surface covering, inhibits movement of the sling in contact with the shooter's clothing.

Competition slings are attached to rifles by an assortment of attachment devices including: conventional fixed sling swivels as found on military rifles, quick detachable hook systems which are used in conjunction with fixed sling swivels, and bayonet type button actuated quick detachable sling swivel systems which are often combined with adjustable rail mounted hand stops.

Examples of these above described prior art slings and quick detachable systems are found in the Shooting Supplies & Equipment Catalog available from Champion's Choice, Inc, of LaVergne, Tenn., and from other similar suppliers.

Deficiencies in the State of the Art

All prior art slings used for competition shooting, including the above listed military and competition slings, incorporate a first attachment. This first attachment joins that portion of the sling which extends to the forestock sling swivel of the rifle and that portion of the sling around the shooter's upper arm. This first attachment occurs at a point on the loop around the shooter's arm nearest a second attachment to the forestock sling swivel of the rifle. For all current slings, this first attachment consists of a joint formed by two runs of a strap drawn together by a buckle, clamp, or keepers at the connection to that portion of the sling system surrounding the shooter's arm. Alternate systems could be imagined in which a single run of strap would include a first attachment to the same point on a loop secured around the shooter's arm.

The prior art slings are represented diagrammatically in FIG. 4. The loop which surrounds the shooter's arm, called the arm loop or cuff, is indicated generally at 20. FIG. 4 also shows deformation caused by the stress of supporting the rifle. This deformation is characterized by a region on the arm loop or cuff which is pulled away from the shooter's arm by the tension in that portion of the sling extending toward the rifle. The diagram also shows the rhythmic pressure represented by arrows indicated typically at 25, placed on the arm loop or cuff by the shooter's blood pressure pulse. This rhythmic pressure causes change in the amount that the arm loop or cuff is pulled away from the shooter's arm. Consequently, with all prior art slings, the pulse in the shooter's arm produces corresponding rhythmic stress fluctuations in that portion of the sling which extends from the arm loop or cuff to the rifle. These rhythmic stress fluctuations, shown at 26, produces undesirable movement in the rifle during aiming and firing resulting in a loss in practical accuracy. This movement occurs as a consequence of the position and singular nature of the prior art first attachment.

BRIEF SUMMARY OF THE INVENTION

The present invention changes both the position and singular nature of the prior art first attachment. FIG. 5 shows a diagram of the invention which is a sling system incorporating a cuff shown at 30, and two separated non parallel strap legs which join the cuff to the rifle at the forestock sling swivel. These strap legs attach on opposing sides of the cuff on a line passing roughly through the center of the cuff The line passing though the attachments occurs nominally perpendicular to a line running from the center of the arm loop or cuff to the forestock sling swivel. In the case of the present invention, the stress of supporting the rifle cannot pull the sling away from the shooter's arm. The rhythmic pressure, placed on the arm loop or cuff by the blood pressure pulse of the shooter, can no longer transfer rhythmic stress to that portion of the sling running from the arm loop or cuff to the rifle. Undesirable movement of the rifle during aiming and firing is reduced and practical accuracy is improved.

DETAILED DESCRIPTION OF THE INVENTION

Figure 1:
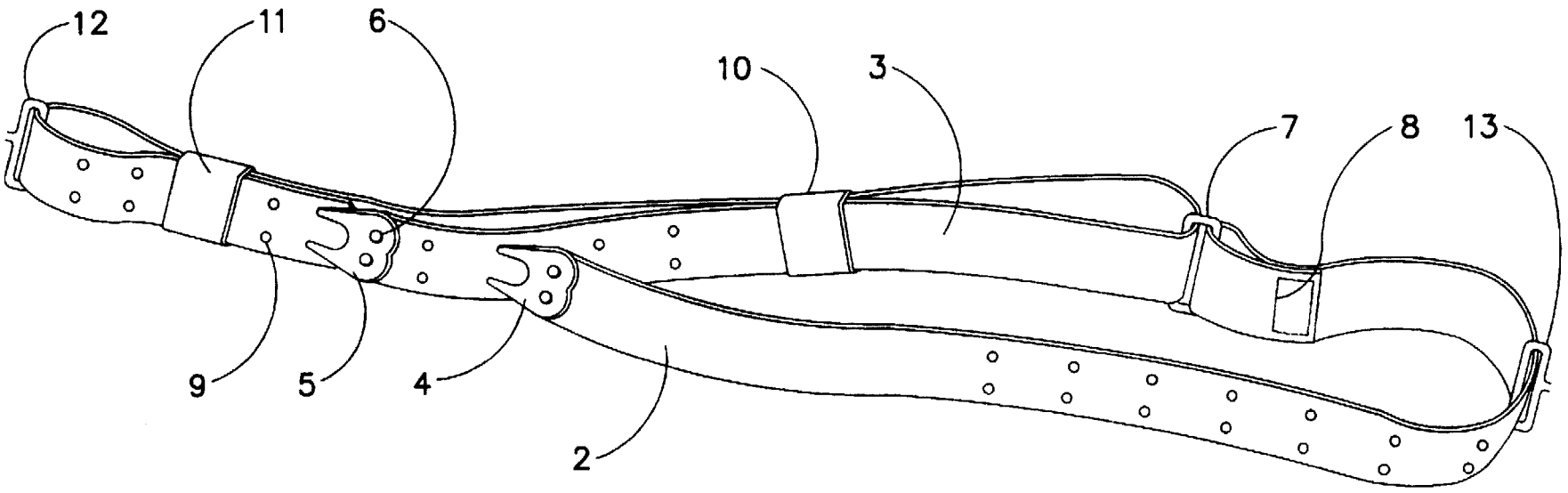
Figure 1. (Prior Art)
FIG. 1 is a side view of a prior art M1907 sling.
Figure 2:
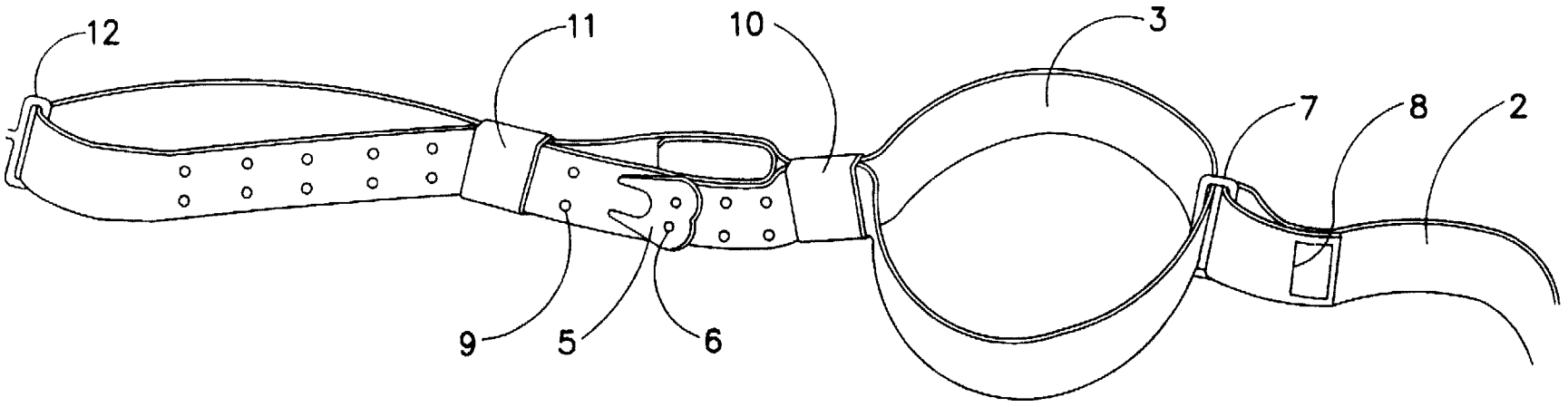
Figure 2. (Prior Art)
FIG. 2 is a side view of a M1907 sling in prior art configuration in preparation for use in support of a rifle during aiming and firing.
Figure 3:
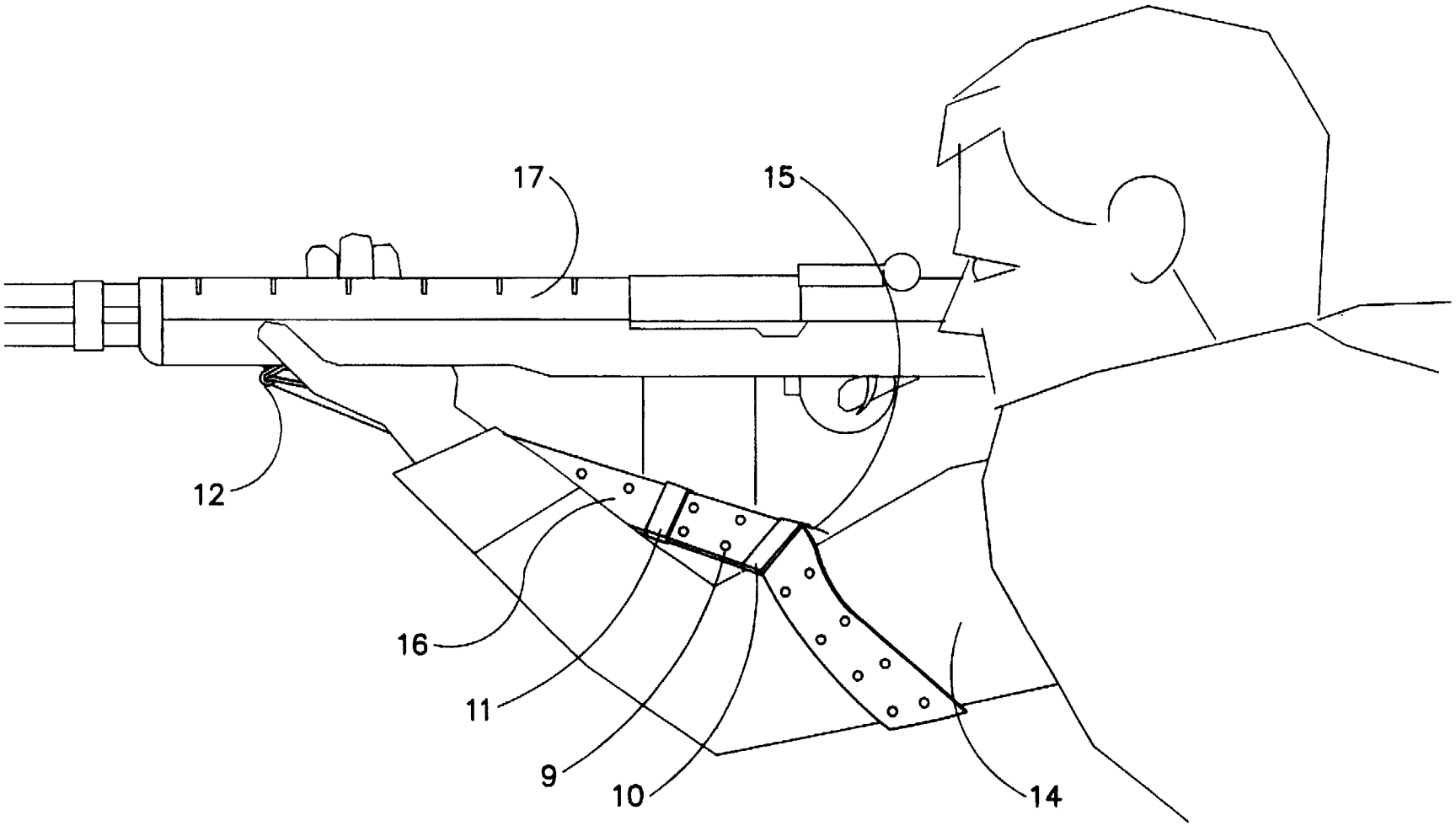
Figure 3. (Prior Art)
FIG. 3 shows a M1907 sling in prior art configuration attached to a rifle and shooter during aiming and firing.

FIGS. 1, 2 and 3 show a prior art M1907 sling including the following component parts: a short strap shown generally at 2, a long strap shown generally at 3, double claw hooks 4 and 5, multiple rivets shown typically at 6, a rectangular ring 7, stitches shown generally at 8, multiple pairs of punched holes shown typically at 9, and sling keepers 10 and 11. FIG. 1 shows said M1907 sling in prior an stored condition connected at a forestock sling swivel 12 and a buttstock sling swivel 13. FIG. 2 shows said M1907 sling configured in prior an preparation for use in support of a rifle during aiming and firing. FIG. 3 shows a M1907 sling in prior an configuration attached to a rifle shown generally at 17 and shooter's upper arm shown generally at 14, during aiming and firing. Part or all of said short strap 2 is omitted for clarity in FIGS. 2 and 3.

FIG. 3 shows a first attachment 15 formed by drawing two legs, shown generally at 16, of said long strap together using said keepers 10 and 11. Said first attachment 15 forms the connection to that portion of the sling system surrounding said upper arm 14. The nature of said first attachment 15 and the stress in said legs 16 of said long strap 3 tend to pull the sling system away from said upper arm 14. This condition where the sling arm loop or cuff is pulled away from the upper arm of the shooter is characteristic of all prior an slings. FIG. 3 also shows said legs 16 of said long strap extending in a direction which is not perpendicular to said upper arm 14, resulting in twisting of said first attachment 15. In some competition slings, twisting is generally avoided through the use of an angled arm loop or angled attachment of the cuff to the strap legs. FIG. 3 also depicts a rifle shown generally at 17 including a second attachment of the sling system to the rifle at said forestock sling swivel 12.

Figure 4:
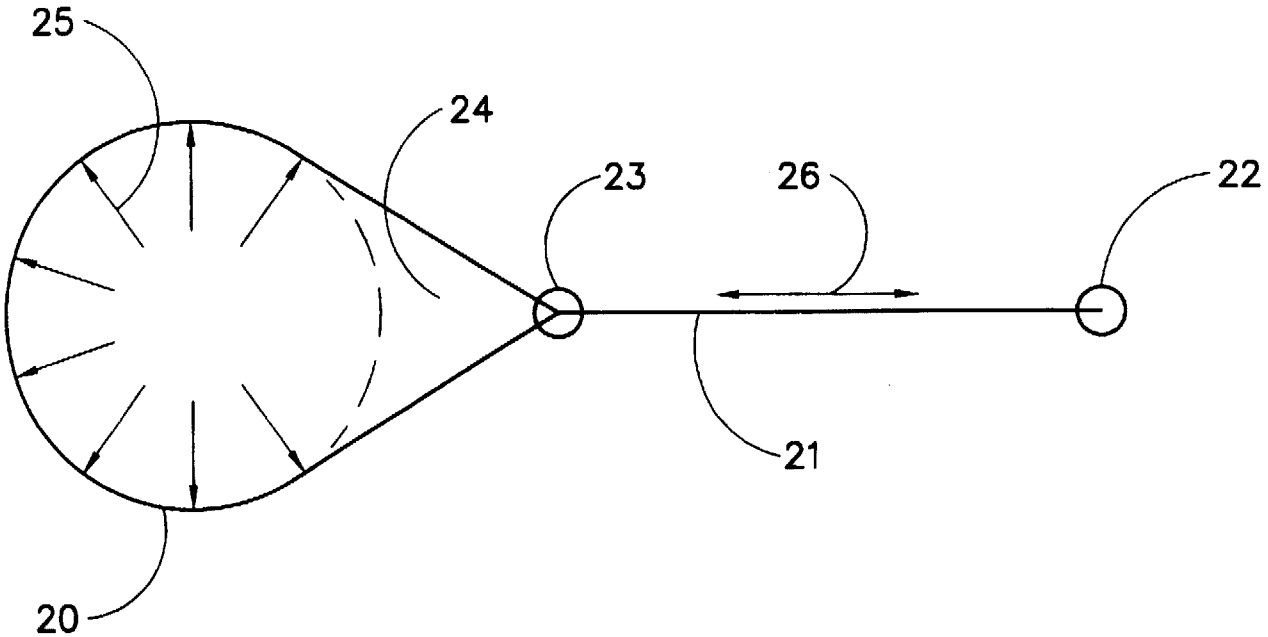
Figure 4. (Prior Art)
FIG. 4 is a diagrammatic representation typical of all prior art slings in use.

FIG. 4 is a diagram representative of prior an slings in use supporting rifles during aiming and firing. An arm loop or cuff is represented generally at 20. Parallel connecting strap legs shown generally at 21 form the extension between said arm loop or cuff 20 and a second attachment 22 with the rifle forestock sling swivel. Connecting strap legs 21 join said arm loop or cuff 20 at a first attachment 23. An area shown at 24 results from the condition where said arm loop or cuff 20 is pulled away from the upper arm of the shooter by the force of supporting the rifle. The pulse of the shooter is represented by multiple radial arrows shown typically at 25 impinging on the inside of said arm loop or cuff 20. Said pulse 25 results in rhythmic deformation of said arm loop or cuff 20 including rhythmic changes in the shape of said area 24. The changes in said area 24 cause variation in stress 26 in said connecting strap legs 21 and in turn result in undesirable motion of the rifle during aiming and firing. Consequently, practical accuracy of the rifle is degraded.

Figure 5:
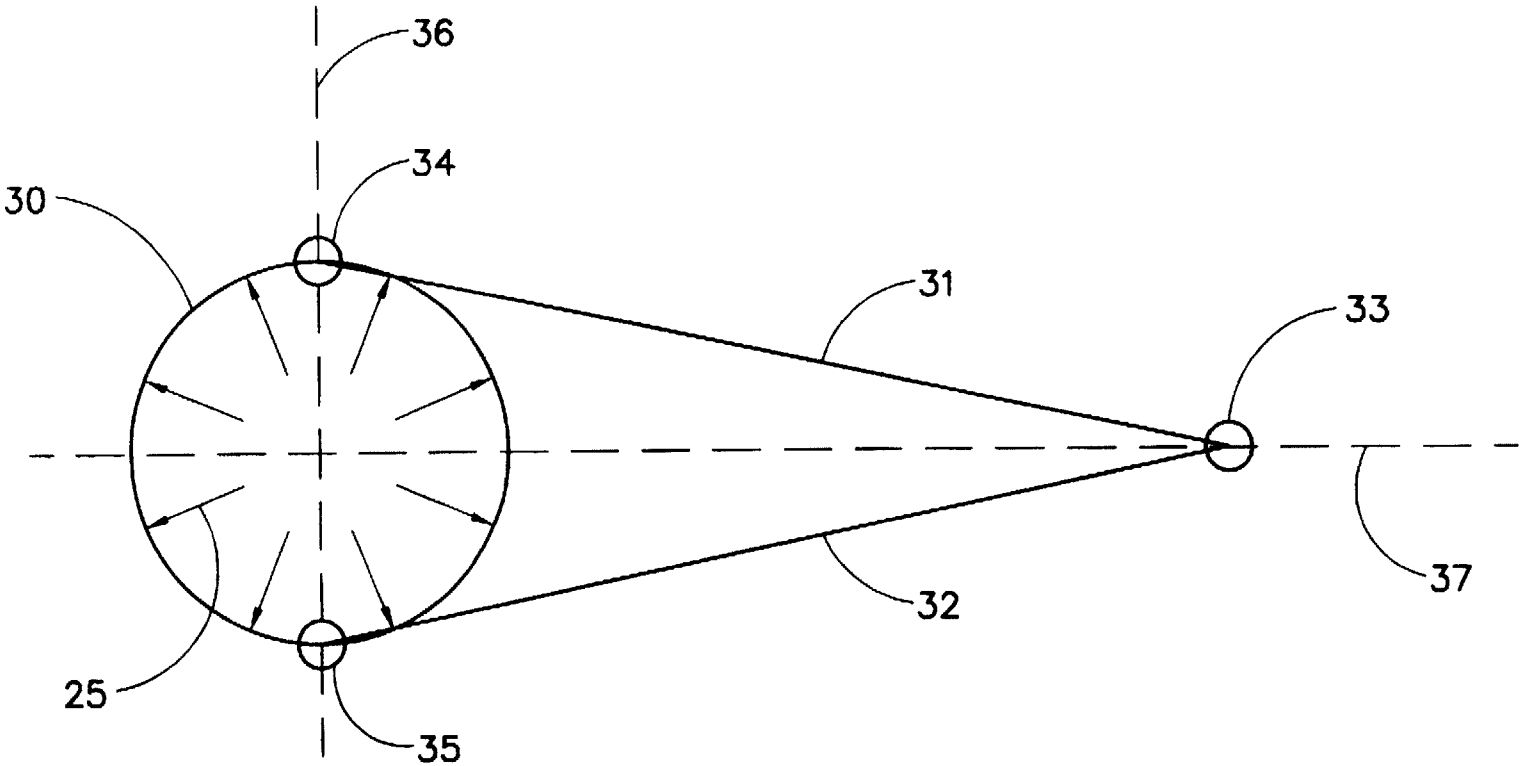
FIG. 5 is a diagrammatic representation of a sling of the present invention in use.

FIG. 5 is a diagrammatic representation of a sling of the present invention in use supporting a title during aiming and firing. A cuff is represented generally at 30. Connecting strap legs shown at 31 and 32 form the extension between said cuff 30 and a second attachment 33 with the rifle forestock sling swivel. In the case of the present invention, said connecting strap legs 31 and 32 are no longer parallel and join with the cuff 30 at a first attachment 34 and a third attachment 35. Attachments 34 and 35 occur on a line 36 running roughly perpendicular to a line 37 from the center of said arm loop or cuff to said attachment 33. Said line 36 passes roughly through the center of said cuff 30. Radial movement of said cuff 30 caused by said pulse 25 in the shooter's arm, can no longer produce rhythmic stress in said connecting strap legs 31 and 32. Motion of the rifle during aiming and firing is reduced and practical accuracy is increased.

Figure 6:
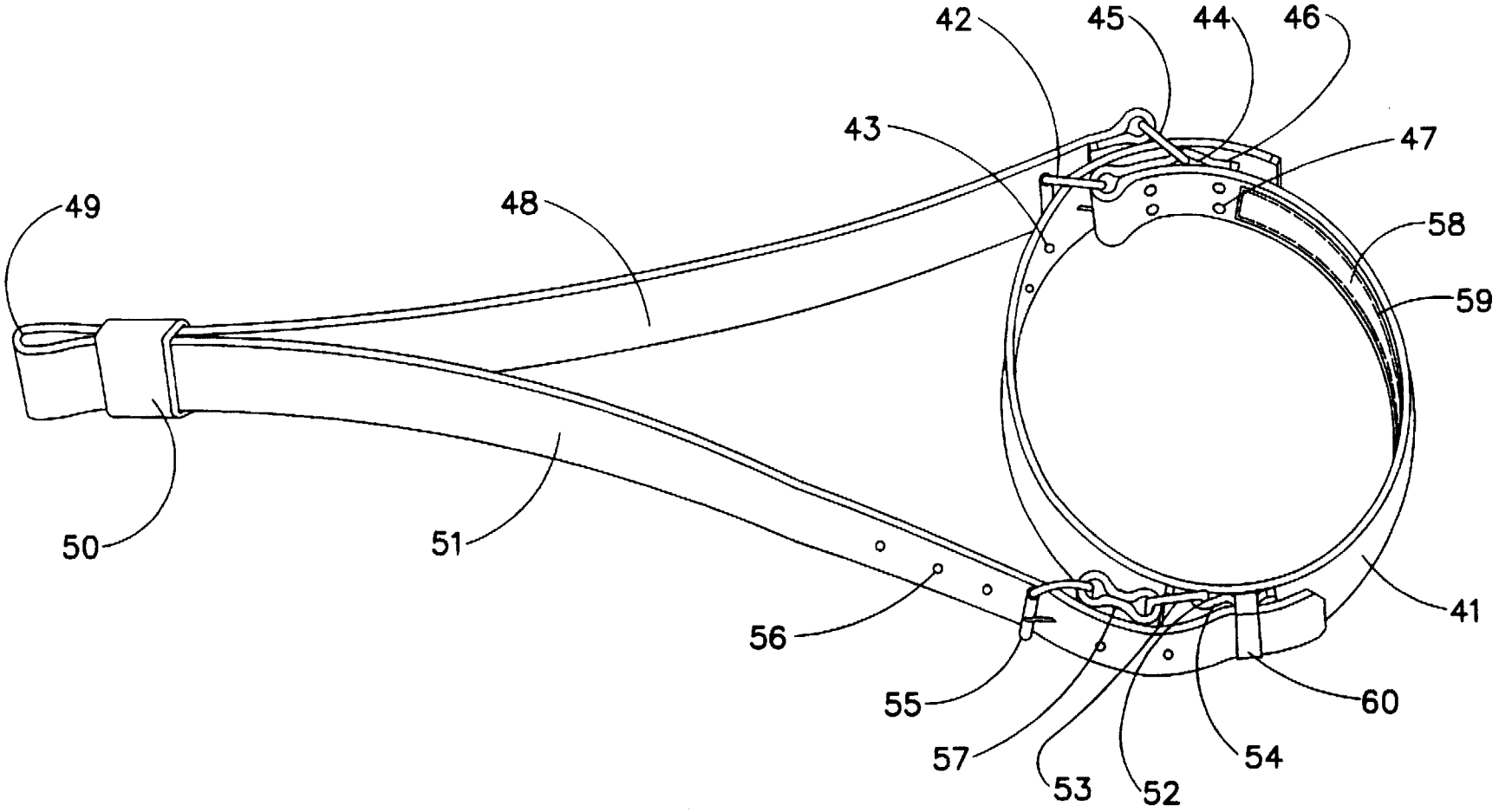
FIG. 6 shows a first preferred embodiment of a sling of the present invention in preparation for use in support of a rifle during aiming and firing.

FIG. 6 shows a first preferred embodiment of a sling of the present invention. Said first preferred embodiment includes the following components: a cuff shown generally at 41 including a first buckle 42 cooperating with multiple holes shown typically at 43 to achieve adjustment to closely fit the shooter's upper arm, a first attachment 44 comprised of a first "D" ring 45 joined to said cuff 41 using a flap 46 and rivets shown typically at 47, a first connecting strap leg 48 joined to said first "D" ring in a loop formed by additional rivets 47, a second attachment 49 for connection to the forestock sling swivel of a rifle, a sling keeper 50, a second connecting strap leg 51, a third attachment 52 comprised of a second "D" ring 53 joined to cuff 41 using a second flap 54 and additional rivets 47. Said second connecting strap leg 51 includes a second buckle 55 cooperating with holes shown typically at 56 to accomplish adjustment in the length of said first connecting strap leg 48 and said second connecting strap leg 51. Said second buckle 55 is joined to said second "D" ring 53 using a third flap 57 and additional rivets 47. The inner surface of said cuff 41 further includes gripping material 58 attached to said cuff 41 by sewn stitches shown typically at 59. A retaining loop 60 is included to capture extra length for adjustment in said strap leg 48 and 51. Minor variations of this first embodiment use stitches in place of rivets at some or all locations.

Figure 7:
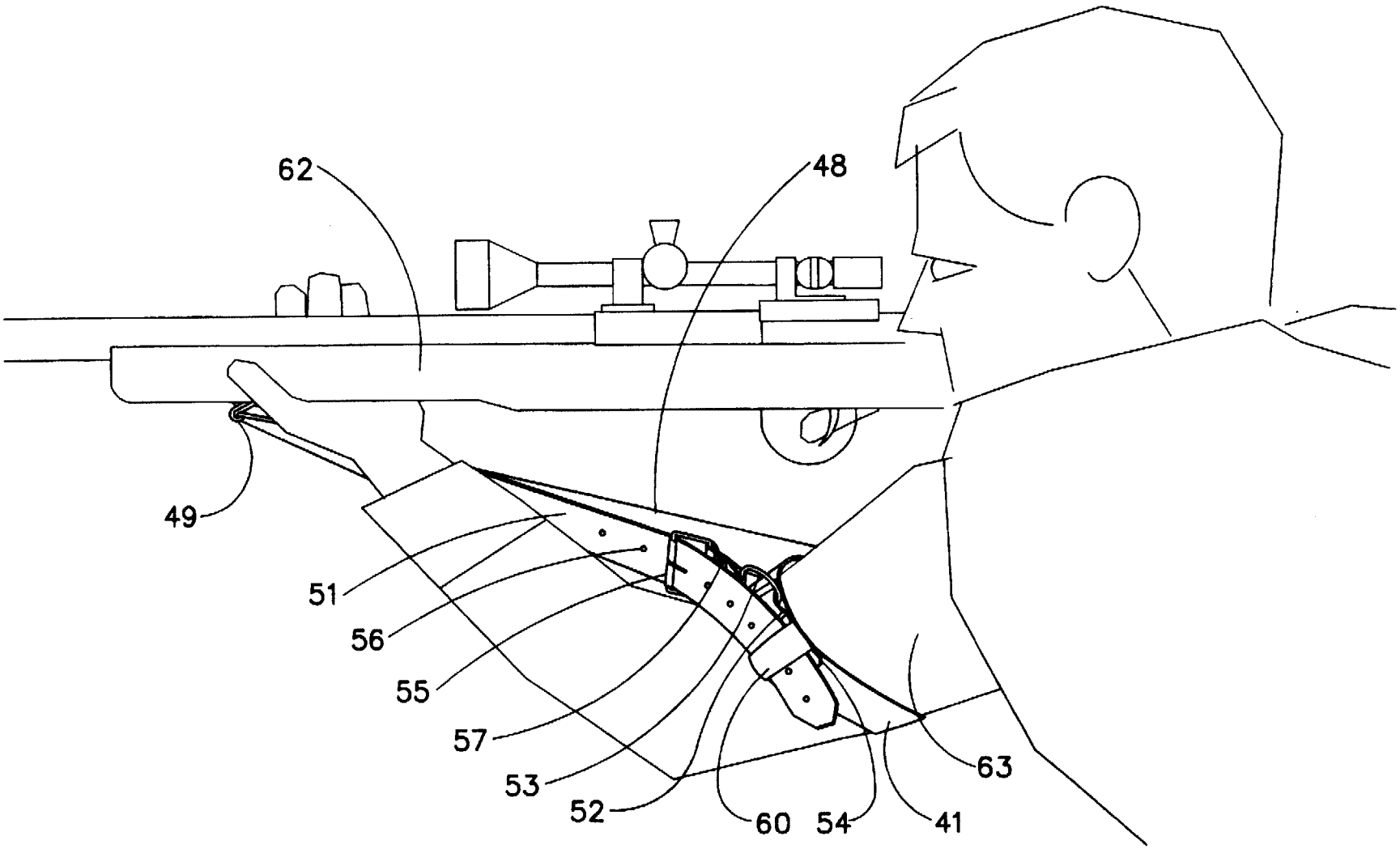
FIG. 7 shows a first preferred embodiment of a sling of the present invention attached to a rifle and shooter during aiming and firing.

FIG. 7 shows said first preferred embodiment of a sling of the present invention attached to a rifle shown generally at 62 and a shooter's upper arm shown generally at 63. Components visible in FIG. 7 are numbered as in FIG. 6. The connecting strap leg or legs of slings do not often extend at right angles to the shooter's upper arm. This deviation from right angle extension is apparent in FIG. 7. The use of "D" rings 45 and 53 automatically and variably accommodates extension of said legs 48 and 51 not at right angles to said shooter's upper arm 63 without twisting of said strap legs 48 and 51, or cuff 41, at said attachments 44 and 52.

Figure 8:
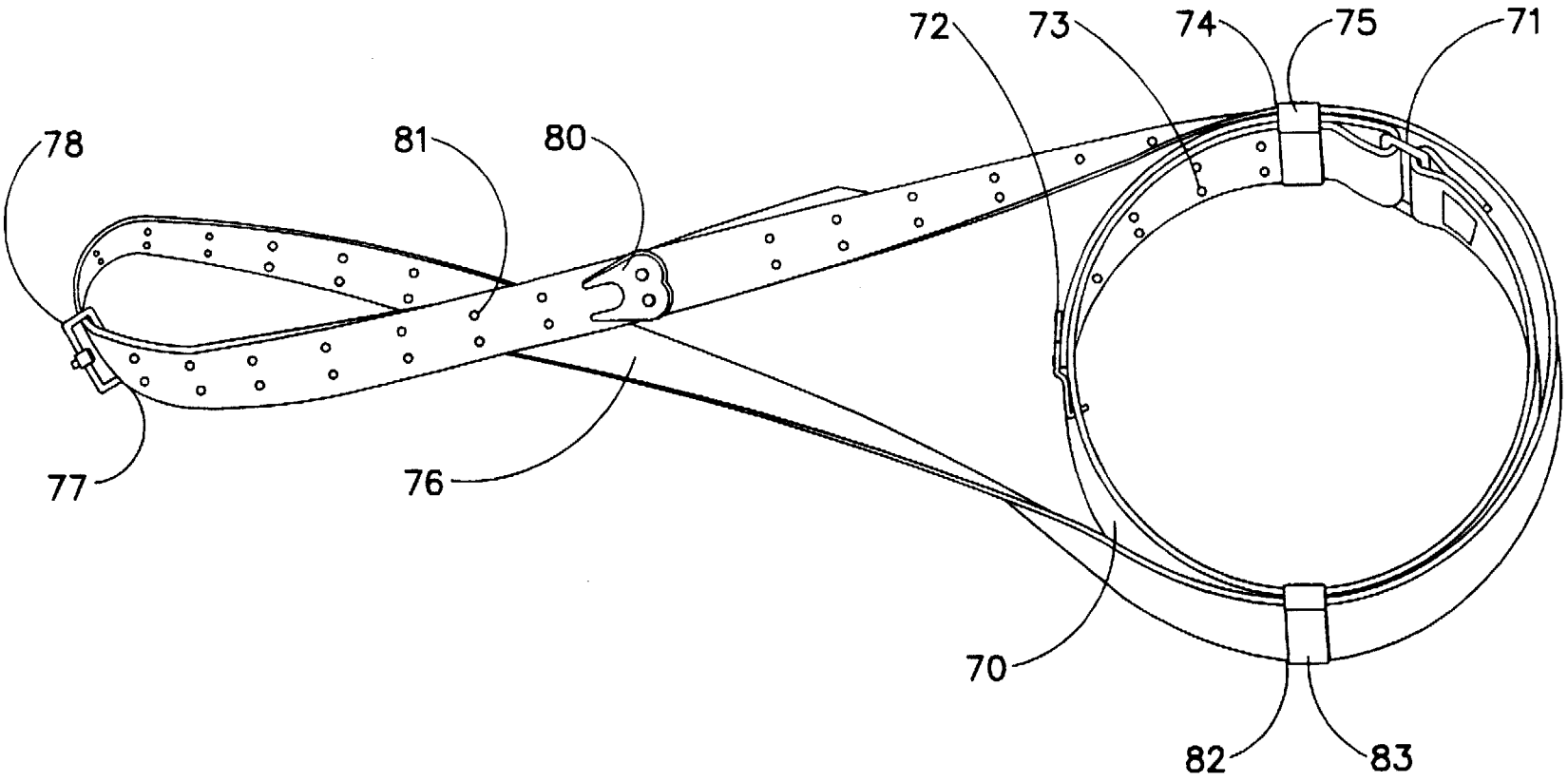
FIG. 8 shows a second preferred embodiment of a sling of the present invention in preparation for use in support of a rifle during aiming and firing.

FIG. 8 shows a second preferred embodiment of a sling of the present invention. Said second embodiment includes the following components: a cuff shown generally at 70 including a rectangular ring 71 and first double claw hook 72 cooperating with multiple double holes shown typically at 73 to achieve adjustment to closely fit the shooter's upper arm, a first attachment 74 comprised of a first sling keeper 75 enclosing a long strap shown generally at 76 and said cuff 70, a second attachment 77 on said long strap 76 for connection to the forestock sling swivel 78 of a rifle, a second double claw hook 80 cooperating with additional double holes shown typically at 81 to achieve adjustment in sling length, and a third attachment 82 comprised of a second sling keeper 83 enclosing said cuff 70 and said long strap 76. Said long strap 76 overlays that half of said cuff 70 found farthest from the rifle sling swivel 78. Said second preferred embodiment would be acceptable for use in service rifle competitions since it can be assembled from the components of the prior art M1907 sling. Said second preferred embodiment has additional advantages over the M1907 sling configured according to the prior art in that it can be disconnected from the rifle without detaching it from the shooter's upper arm and is more easily adjusted for length.

Figure 9:
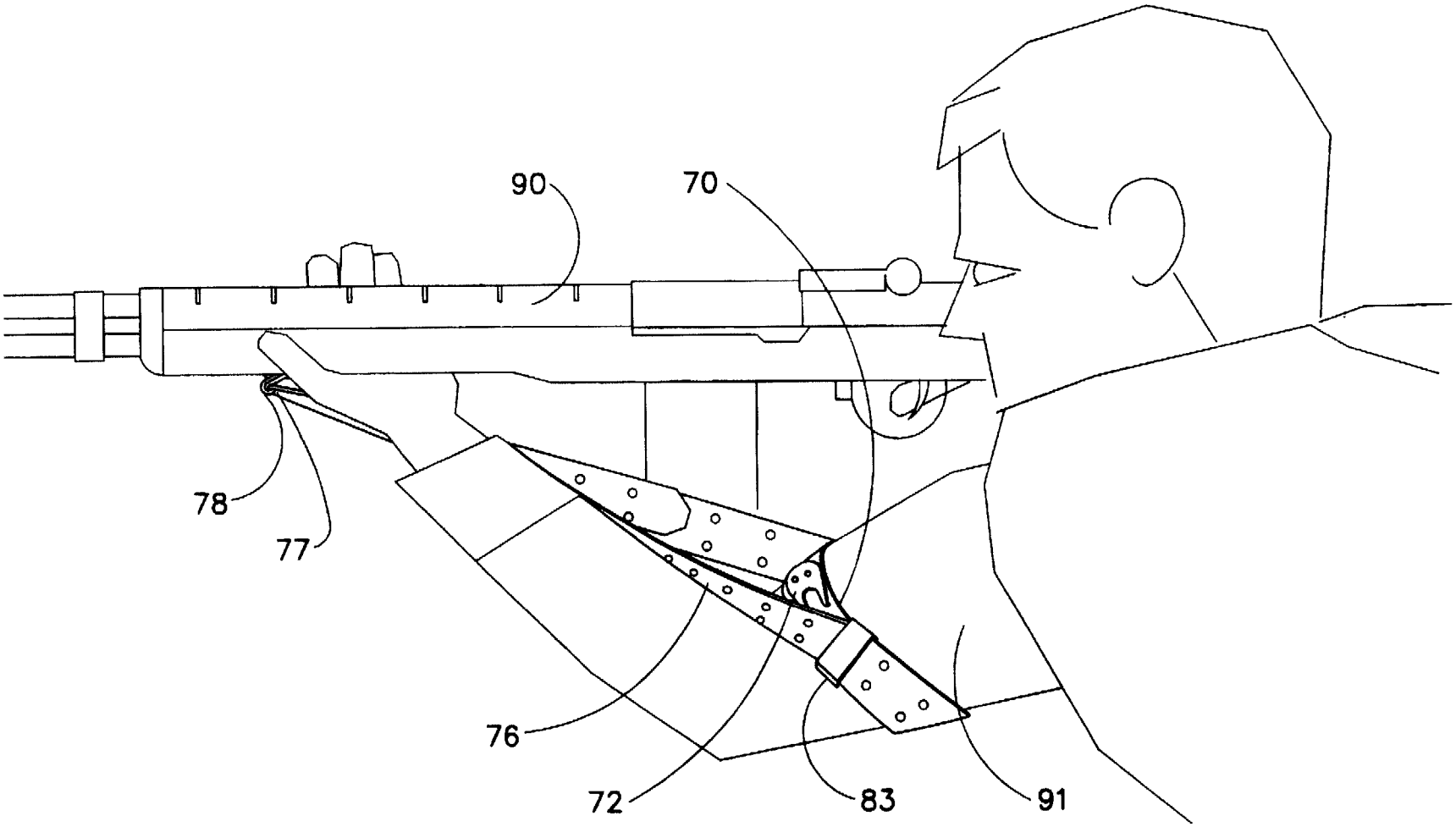
FIG. 9 shows a second preferred embodiment of a sling of the present invention attached to a rifle and shooter during aiming and firing.

FIG. 9 shows said second preferred embodiment of a sling of the present invention attached to a rifle shown generally at 90 and a shooter's upper arm shown generally at 91. Components visible in FIG. 9 are number as in FIG. 8.

What is claimed is:

1. A no-pulse rifle sling for a rifle having a butt end and a forestock having a swivel mounted thereto comprising: a cuff with means to accommodate adjustment to fit the upper arm of a shooter, and two strap legs extending between first and second ends thereof in a non-parallel relation, a first end of each connected to attachments on said cuff and said second end of each adapted to be connected to a connection at the forestock sling swivel of a rifle;

said attachments occur on substantially diametrically opposed opposite sides of said cuff on a first line roughly perpendicular to a second line from the center of said cuff to said forestock sling swivel; and said non parallel strap legs include accommodation for adjustment in length between said upper arm and said forestock sling swivel.

2. A no-pulse rifle sling as in claim 1 wherein said attachments consist of "D" rings joined to said cuff by flaps held in place with rivets and said "D" rings are joined to said non parallel strap legs in loops formed by rivets.

3. A no-pulse rifle sling as in claim 1 wherein said attachments consist of "D" rings joined to said cuff by flaps held in place with stitches and said "D" rings are joined to said non parallel strap legs in loops formed by stitches.

4. A no-pulse rifle sling as in claim 1 wherein said cuff consists of a short strap including:

a first set of multiple double holes, a first double claw hook attached to one end of said short strap using rivets, and a metal rectangular ring connected to the opposite end of said short strap in a loop created by sewn stitches;

said first double claw hook passing through said rectangular ring and cooperating with said first set of double holes to form said cuff and to accommodate adjustment to fit said upper arm.

5. A no-pulse rifle sling as in claim 4 wherein said non parallel strap legs are formed by a long strap including:

a second double claw hook attached at one end of said long strap using rivets, and a second set of multiple double holes;

said second double claw hook and said second set of multiple double holes cooperating to join the ends of said long strap in order to overlay that half of said cuff found farthest from the rifle sling swivel; and said attachments consist of keepers enclosing said cuff and said non parallel strap legs.

* * * * *